US006612283B1

(12) United States Patent
Philipp

(10) Patent No.: US 6,612,283 B1
(45) Date of Patent: Sep. 2, 2003

(54) FUEL INJECTION METHOD

(75) Inventor: Matthias Philipp, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,725

(22) PCT Filed: Jul. 23, 1999

(86) PCT No.: PCT/DE99/02260

§ 371 (c)(1),
(2), (4) Date: Oct. 10, 2000

(87) PCT Pub. No.: WO00/37788

PCT Pub. Date: Jun. 29, 2000

(30) Foreign Application Priority Data

Dec. 28, 1998 (DE) ..... 198 59 424

(51) Int. Cl.[7] ..... F02M 17/00
(52) U.S. Cl. ..... 123/295; 123/406.33; 123/406.29
(58) Field of Search ..... 123/406.3, 399, 123/295, 406.29, 406.23

(56) References Cited

U.S. PATENT DOCUMENTS 5,922,372 A * 7/1999 Schad ..... 425/595
5,947,077 A 9/1999 Yonezawa et al.
6,041,755 A * 3/2000 Mashiki ..... 123/406.29
6,145,490 A * 11/2000 Heidenfelder et al. ..... 123/295

FOREIGN PATENT DOCUMENTS

| | | |
|---|---|---|
| DE | 196 31 986 | 2/1998 |
| EP | 0 849 454 | 6/1998 |
| JP | 04 187851 | 7/1992 |
| JP | 09 303189 | 11/1997 |

* cited by examiner

*Primary Examiner*—Bibhu Mohanty
(74) *Attorney, Agent, or Firm*—Kenyon & Kenyon

(57) ABSTRACT

A fuel injection method for an internal combustion engine, an injection being implemented either in homogeneous normal operation or in inhomogeneous stratified operation. In doing so, a characteristic value for knock is detected in at least one cylinder of the internal combustion engine in inhomogeneous stratified operation. At least the one cylinder is switched over from inhomogeneous stratified operation to homogeneous normal operation if the detected characteristic value of the one cylinder meets a predetermined first criterion.

19 Claims, 1 Drawing Sheet

FUEL INJECTION METHOD

FIELD OF THE INVENTION

The present invention relates to a fuel injection method for an internal combustion engine, injection being implemented either in homogeneous normal operation or in inhomogeneous stratified operation.

BACKGROUND INFORMATION

Although it is applicable to any fuels and engines of any vehicles, the present invention and its underlying problems are explained in relation to gasoline direct injection of an internal combustion engine of a passenger car.

In such internal combustion engines with gasoline direct injection, charge stratification is implemented in the combustion chamber, which will be identified below as stratified operation, for the complete utilization of the consumption advantage in certain operating ranges.

In normal operation of gasoline direct injection, the entire combustion chamber is homogeneously filled with a stoichiometric air-fuel mixture which is ignited by the ignition spark at the moment of ignition.

In stratified operation, however, only a small stoichiometric cloud is introduced into the combustion chamber, the cloud being ignitable locally while the remaining contents of the combustion chamber cannot be ignited. The advantage of such stratified operation lies in the expanded lean operation of the internal combustion engine and consequently an ultimate saving of fuel.

Accordingly, it is desirable to make the operating range of the stratified operation as great as possible, extending it in particular to as high loads and speeds as possible.

The problem underlying the present invention is generally that a fixed moment of ignition is necessary to be able to ignite the stratified charge in the combustion chamber reliably. At certain operating points, this fixed moment of ignition may possibly be very early, typically up to a crankshaft position of 50° in advance of top dead center (TDC).

In this connection, it has proven to be disadvantageous that combustion knock may occur with such operating points in stratified unthrottled operation. Since the ignition angle cannot be varied, i.e., adjusted to a "later" value or one that is closer to TDC, other measures are required to eliminate any combustion knock that may occur.

SUMMARY

In contrast to the known approaches, the fuel injection method according to the present invention has the advantage that the internal combustion engine is operated as far as possible in the fuel-saving stratified operation and is only switched over to homogeneous normal operation if combustion knock (for example, at high intake air and/or coolant temperatures) makes this absolutely necessary since otherwise there would be a danger of damaging parts of the engine.

The idea underlying the present invention is that a switchover from inhomogeneous stratified operation to homogeneous normal operation is made when combustion knock occurs. If a knock should still be present after the switchover and throttling in homogeneous normal operation, an additional possible reaction is to adjust the ignition angle, which is not possible in inhomogeneous stratified operation According to an example embodiment, the knock intensity is detected as a characteristic value for knock in at least one cylinder of the internal combustion engine in inhomogeneous stratified operation and at least the one cylinder is switched over from inhomogeneous stratified operation to homogeneous normal operation if the knock intensity of the one cylinder exceeds a predetermined first knock intensity threshold.

According to another example improvement, the knock frequency is detected as a characteristic value for knock in multiple cylinders of the internal combustion engine in inhomogeneous stratified operation and multiple cylinders are switched over from inhomogeneous stratified operation to homogeneous normal operation if the knock frequency of the multiple cylinders exceeds a predetermined first knock frequency threshold.

According to another example development, a throttling in homogeneous normal operation is implemented after the switchover, the characteristic value for knock is detected in at least one cylinder of the internal combustion engine in homogeneous normal operation and the ignition angle is adjusted if the detected characteristic value of the one cylinder meets a predetermined second criterion, preferably with regard to knock intensity or knock frequency.

According to another example development, the homogeneous normal operation is implemented during an operating point-dependent time interval and at least the one cylinder is switched over from homogeneous normal operation to inhomogeneous stratified operation.

According to another example development, a characteristic value for knock is detected in at least one cylinder of the internal combustion engine in homogeneous normal operation and at least the one cylinder is switched over from normal homogeneous operation to inhomogeneous stratified operation after implementation of homogeneous normal operation during an operating point-dependent time interval only if the detected characteristic value of the one cylinder meets a predetermined third criterion, preferably with regard to knock intensity or knock frequency.

According to another example development, a characteristic curve is determined at which a switchover between homogeneous normal operation and inhomogeneous stratified operation is implemented as a function of at least one engine-specific parameter, preferably speed and load, and at least one part of the characteristic curve is shifted in response to the fact that at one operating point, for which the inhomogeneous stratified operation is provided, it is determined that the detected characteristic value of the one cylinder meets a predetermined fourth criterion, preferably with regard to knock intensity or knock frequency.

According to another example development, one interpolation point of the characteristic curve corresponding to the operating point is shifted by a predetermined first amount to an adapted interpolation point.

According to another example development, the knock intensity is detected as a characteristic value for knock in the at least one cylinder of the internal combustion engine in inhomogeneous stratified operation and the part of the characteristic curve is shifted if the knock intensity of the one cylinder exceeds a predetermined second knock intensity threshold which is lower than the first knock intensity threshold.

According to another example development, the knock frequency is detected as a characteristic value for knock in multiple cylinders of the internal combustion engine in inhomogeneous stratified operation and the part of the characteristic curve is shifted if the knock frequency of the one cylinder exceeds a predetermined second knock frequency threshold which is lower than the first knock frequency threshold.

According to another example development, the adapted interpolation point of the characteristic curve corresponding to the operating point is shifted back by a predetermined second amount in the direction of the original interpolation point if the detected characteristic value of the one cylinder meets a predetermined fifth criterion, preferably with regard to knock intensity or knock frequency, for a specific time interval, the predetermined second amount preferably being lower than the predetermined first amount.

According to another example development, the cylinders are controllable by individual single throttle valves, and the detection and the switchover is implemented separately for each cylinder.

According to an additional preferred further development, at least one cylinder is throttled in inhomogeneous stratified operation if the detected characteristic value of the one cylinder meets a predetermined sixth criterion, preferably with regard to knock intensity or knock frequency.

According to another example development, the knock intensity is detected as a characteristic value for knock in the at least one cylinder of the internal combustion engine in inhomogeneous stratified operation and at least the one cylinder is throttled in inhomogeneous stratified operation if the knock intensity of the one cylinder exceeds a predetermined third knock intensity threshold which is lower than the predetermined first and second knock intensity threshold.

According to another example embodiment development, the knock frequency is detected as a characteristic value for knock in multiple cylinders of the internal combustion engine in inhomogeneous stratified operation and the multiple cylinders are throttled in inhomogeneous stratified operation if the knock frequency of the multiple cylinders exceeds a predetermined third knock frequency threshold which is lower than the predetermined first and second knock frequency threshold.

DETAILED DESCRIPTION

Figure 1:
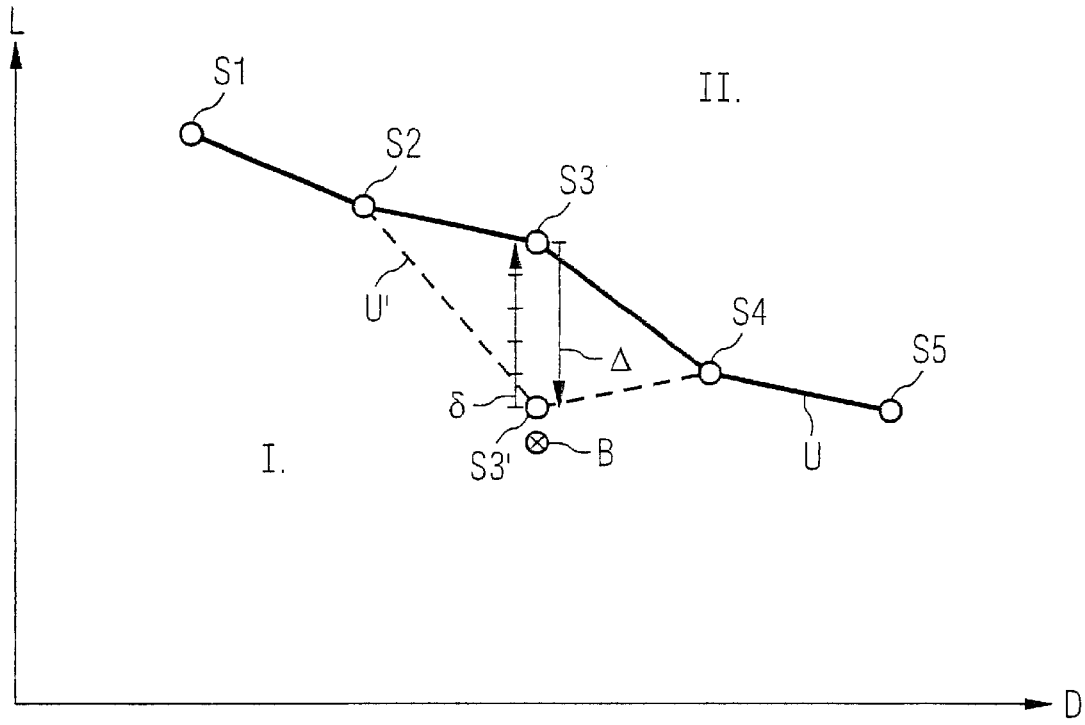
FIG. 1 shows a diagrammatic representation of the adjustment of a characteristic curve in which a switchover is made between homogeneous stratified operation as a function of speed and load according to an example embodiment of the fuel injection method according to the present invention.

An example embodiment of the fuel injection method according to the present invention is explained with reference to FIG. 1. In FIG. 1, D identifies the speed and L the load of the internal combustion engine in question; U identifies the characteristic curve at which a switchover is made between homogeneous normal operation and inhomogeneous stratified operation as a function of speed D and load L, S1–S5 being interpolation points of characteristic curve U, between which interpolation is advantageously carried out. In this connection, I is the area for inhomogeneous stratified operation and II is the area for homogeneous normal operation. S3' is an adapted interpolation point and U' is a correspondingly adapted characteristic curve. Δ is an amount of shift of interpolation point S3 in the direction of area II and δ is a corresponding amount of return shift in the direction of area I.

In this embodiment of the fuel injection method of the present invention for an internal combustion engine having a throttle valve and an intake manifold, continuous detection of the knock intensity as a characteristic value for knock takes place in each cylinder of the internal combustion engine in inhomogeneous stratified operation and in homogeneous normal operation.

If the knock intensity of a cylinder in inhomogeneous stratified operation exceeds a predetermined first knock intensity threshold, all cylinders are switched over from inhomogeneous stratified operation to homogeneous normal operation.

In homogeneous normal operation, throttling occurs after the switchover and the detection of knock intensity is continued.

If the knock intensity is still too high, the ignition angle can be adjusted in homogeneous normal operation.

After implementation of homogeneous normal operation during an operating point-dependent time interval, all cylinders are switched over from homogeneous normal operation to inhomogeneous stratified operation if the knock intensity is sufficiently low.

Moreover, in this embodiment a change in characteristic curve U takes place in response to the fact that at one operating point, B in this case, for which the inhomogeneous stratified operation is provided, it is determined that the detected characteristic value of one cylinder meets a predetermined criterion, namely if the knock intensity of at least one cylinder exceeds a predetermined second knock intensity threshold which is lower than the first knock intensity threshold.

In particular, interpolation point S3 of characteristic curve U corresponding to operating point (B) is shifted by a predetermined first amount A to an adapted interpolation point S3'. From this, it is possible to form adapted characteristic curve part U' (dashed lines) at which the switchover between inhomogeneous stratified operation and homogeneous normal operation takes place.

If no cylinder is still above the second knock intensity threshold, adapted interpolation point S3' of characteristic curve U corresponding to operating point B is shifted back by a predetermined second amount δ in the direction of original interpolation point S3, predetermined second amount δ being lower than predetermined first amount Δ. This is repeated periodically until original interpolation point S3 is attained again.

The switchover between inhomogeneous stratified operation and homogeneous normal operation takes place in each case according to the instantaneously adapted characteristic curve.

In a further embodiment in which the cylinders are controllable by individual single throttle valves, not only the detection but also the switchover can be implemented separately for each cylinder.

In a still further embodiment, a cylinder in inhomogeneous stratified operation can be throttled if the knock intensity of the one cylinder exceeds a predetermined third knock intensity threshold which is lower than the predetermined first and second knock intensity threshold. The extent to which this throttling can occur depends on the engine type in question.

Although the present invention was described above using the example embodiments, it is not limited to them but rather can be modified in many ways.

It is obvious that the knock intensity and the knock frequency may also be detected simultaneously.

More complex characteristic curves may also be used by applying multiple parameters.

Finally, the characteristic curve can be adapted in any manner and is not limited to the type shown.

What is claimed is:

1. A fuel injection method for an internal combustion engine, comprising:

implementing fuel injection in one of a homogeneous normal operation and an inhomogeneous stratified operation;

detecting a characteristic value for knock in at least one cylinder of the internal combustion engine in the inhomogeneous stratified operation; and switching the at least the one cylinder from the inhomogeneous stratified operation to the homogeneous normal operation if the detected characteristic value of the at least one cylinder meets a predetermined first criterion.

2. The method according to claim 1, further comprising:

detecting a knock intensity as the characteristic value for knock in the at least one cylinder in inhomogeneous stratified operation; and switching the at least one cylinder from the inhomogeneous stratified operation to the homogeneous normal operation if the knock intensity of the at least one cylinder exceeds a predetermined first knock intensity threshold.

3. The method according to claim 1, wherein the at least one cylinder including multiple cylinders, the method further comprising:

detecting a knock frequency as the characteristic value for knock in the multiple cylinders of the internal combustion engine in inhomogeneous stratified operation; and switching the multiple cylinders from the inhomogeneous stratified operation to the homogeneous normal operation if the knock frequency of the multiple cylinders exceeds a predetermined first knock frequency threshold.

4. The method according to claim 1, further comprising:

implementing a throttling in the homogeneous normal operation after the switching step;

detecting the characteristic value for knock in the at least one cylinder of the internal combustion engine in homogeneous normal operation; and adjusting an ignition angle if the detected characteristic value of the at least one cylinder meets a predetermined second criterion.

5. The method according to claim 4, wherein the adjusting step includes adjusting the ignition angle if the detected characteristic value of the at least one cylinder meets a second predetermined criterion with respect to at least one of a knock intensity and a knock frequency.

6. The method according to claim 1, further comprising:

implementing the homogeneous normal operation during an operating point-dependent time interval; and switching the at least one cylinder from the homogeneous normal operation to the inhomogeneous stratified operation.

7. The method according to claim 6, further comprising:

detecting the characteristic value for knock in the at least one cylinder of the internal combustion engine in the homogeneous normal operation; and switching the at least the at least one cylinder from the homogeneous normal operation to the inhomogeneous stratified operation after implementing the homogeneous normal operation during an operating point-dependent time interval only if the detected characteristic value of the at least one cylinder meets a predetermined third criterion.

8. The method according to claim 7, wherein the step of switching the at least one cylinder from the homogeneous normal operation to the inhomogeneous stratified operation after implementing includes the step of switching the at least one cylinder from the homogeneous normal operation to the inhomogeneous stratified operation after implementing the homogeneous normal operation during the operating point-dependent time interval only if the detected characteristic value of the at least one cylinder meets the predetermined third criterion with respect to one of knock intensity and knock frequency.

9. The method according to claim 7, further comprising:

determining a characteristic curve at which a switchover between the homogeneous normal operation and the inhomogeneous stratified operation is implemented as a function of at least one engine specific parameter; and shifting at least one part of the characteristic curve in response to determining that the detected characteristic value of the at least one cylinder meets a predetermined fourth criterion at an operating point for which the inhomogenous stratified operation is provided.

10. The method according to claim 9, wherein the step of shifting the at least one part of the characteristic curve includes the step of shifting the at least one part of the characteristic curve in response to determining that the detected characteristic value of the at least one cylinder meets the predetermined fourth criterion at the operating point with respect to one of knock intensity and knock frequency at the operating point for which the inhomogeneous stratified operation is provided.

11. The method according to claim 9, further comprising:

shifting one original interpolation point of the characteristic curve corresponding to the operating point by a predetermined first amount to an adapted interpolation point.

12. The method according to claim 9, further comprising:

detecting of a knock intensity as the characteristic value for knock in the at least one cylinder of the internal combustion engine in the inhomogeneous stratified operation; and shifting a part of the characteristic curve if the knock intensity of the at least one cylinder exceeds a predetermined second knock intensity threshold which is lower than a first knock intensity threshold.

13. The method according to claim 9, further comprising the steps of:

detecting a the knock frequency as the characteristic value for knock in multiple cylinders of the internal combustion engine in the inhomogeneous stratified operation; and shifting a part of the characteristic curve if the knock frequency of the multiple cylinders exceeds a predetermined second knock frequency threshold which is lower than a first knock frequency threshold.

14. The method according to claim 11, further comprising:

shifting back the adapted interpolation point of the characteristic curve corresponding to the operating point by a predetermined second amount in a direction of the original interpolation point if the detected characteristic value of the one cylinder meets a predetermined fifth criterion, for a specific time interval, the predetermined second amount being lower than the predetermined first amount.

15. The method according to claim 1, wherein the at least one cylinder is controllable by individual single throttle valves and the detection and switchover are implemented separately for each of the at least one cylinder.

16. The method according to claim 1, further comprising the step of:

throttling of the at least one cylinder in the inhomogeneous stratified operation if the detected characteristic value of the at least one cylinder meets a predetermined sixth criterion.

17. The method according to claim 16, wherein the throttling step includes throttling the at least one cylinder in the inhomogeneous stratified operation if the detected characteristic value of the at least one cylinder meets the predetermined sixth criterion with respect to one of a knock intensity and a knock frequency.

18. The method according to claim 16, further comprising the steps of:

detecting a knock intensity as the characteristic value for knock in the at least one cylinder in inhomogeneous stratified operation; and throttling the at least one cylinder in the inhomogeneous stratified operation if the knock intensity of the at least one cylinder exceeds a predetermined third knock intensity threshold which is lower than a predetermined first and second knock intensity threshold.

19. The method according to claim 16, further comprising:

detecting a knock frequency as the characteristic value for knock in multiple cylinders of the internal combustion engine in the inhomogeneous stratified operation; and throttling the multiple cylinders in the inhomogeneous stratified operation if the knock frequency of the multiple cylinders exceeds a predetermined third knock frequency threshold which is lower than a predetermined first and second knock frequency threshold.

* * * * *